US005203453A

United States Patent [19]

Dirito

[11] Patent Number: 5,203,453

[45] Date of Patent: Apr. 20, 1993

[54] GOLF STANCE DEVICE

[76] Inventor: Anthony R. Dirito, 1604 Sherman St., Alameda, Calif. 94501

[21] Appl. No.: 868,849

[22] Filed: Apr. 16, 1992

[51] Int. Cl.[5] ..... A63B 55/00; A63B 69/36

[52] U.S. Cl. ..... 206/315.3; 273/187 R; 273/DIG. 21; 33/760; 33/761; 33/768; 33/759; 33/508; 224/921

[58] Field of Search ..... 273/DIG. 21, 187 R, 273/187 A, 187 B, 187.1; 33/508, 755, 759, 760, 761, 769, 770, 484; 206/315.3

[56] References Cited

U.S. PATENT DOCUMENTS

| | | | |
|---|---|---|---|
| 1,922,130 | 8/1933 | Haserodt | 273/187 R |
| 2,025,519 | 12/1935 | Lingg | 33/508 |
| 2,150,580 | 3/1939 | Crowley | 33/508 X |
| 2,840,914 | 7/1958 | Buckelew | 33/761 X |
| 2,886,326 | 5/1959 | Olds | 273/187 R |
| 3,335,498 | 8/1967 | Barbee | 33/761 X |
| 3,459,429 | 8/1969 | Green | 273/187 R |
| 3,658,344 | 4/1972 | Kimble | 273/187 R |
| 3,708,174 | 1/1973 | Kamarauskas | 273/DIG. 21 |
| 4,200,984 | 5/1980 | Fink | 33/755 X |
| 4,273,329 | 6/1981 | Trigg et al. | 33/755 X |
| 4,532,712 | 8/1985 | Vistain | 33/508 X |
| 4,544,161 | 10/1985 | Guendling, Jr. | 273/187 R |
| 4,880,232 | 11/1989 | Lang | 33/760 X |
| 4,967,482 | 11/1990 | Hoover et al. | 33/484 X |

*Primary Examiner*—George J. Marlo
*Attorney, Agent, or Firm*—Richard C. Litman

[57] ABSTRACT

A golf stance device for locating the feet of a golfer properly with respect to a golf ball. The device is formed of an elongated flat strip of material such as plastic or metal adapted to rest upon the ground and a housed roll-up tape slidably engaged therewith by sliding the flat strip through slots in a flexible disk attached to the tape housing. The roll-up tape may be extended in a direction normal to the elongated strip toward a golf ball providing a device having a member parallel with the golfer's line of sight and properly displaced from the ball. Both the elongated strip of material and the tape have indicia assisting a golfer in positioning the device upon the ground and in obtaining a proper stance. The device is portable and easily mounted upon a golf bag.

11 Claims, 2 Drawing Sheets

RIGHT FOOT
LEFT FOOT
91
61
31
5W
1W
18"
20"
21"
26"
10
12
14
16
18
20
22
24
26
28
30
32
34
36
38
56

GOLF STANCE DEVICE

FIELD OF THE INVENTION

The present invention relates generally to the game of golf and particularly to golf ball positioning devices or training aids used to assist a player in perfecting his stance, building confidence, and reducing time between shots.

BACKGROUND OF THE INVENTION

The game of golf is an outdoor game played on a large grassy course with a series of nine or eighteen holes spaced far apart, the object being to drive a small hard ball, using special clubs, into each hole with as few strokes as possible. In minimizing the number of strokes required to circumscribe the course, proper positioning of the player's feet is paramount. If the player's feet are improperly positioned with respect to the ball during his swing, poor shots frequently result.

The positioning of a player's feet with respect to a golf ball is known as a "stance". Just as people vary in size and shape, a proper golf stance will vary from one individual to another. Additionally, proper stance will vary from shot to shot depending on where the ball is to be driven. For example, the proper stance for a player hitting a long drive down a wide fareway will be substantially different from that of the same player hitting a chip shot of a few yards.

Many novice players will show their unfamiliarity with the game by changing their stance several times before swinging the club and consuming much time in the process. Unfortunately, the proper stance for a given shot is usually determined individually through years of practice and experience. Furthermore, the game of golf cannot be perfected when each shot with the same club is made from a different position relative to the ball as is frequently done by novices. Only by repetition of stance and swing can the player develop consistency in his game and reduce time between shots.

Over the years, devices have been developed to indicate the proper positioning of a golf ball relative to a player's feet, providing novices with additional guidance while on the golf course. Several types of devices are known in the art, but most are complex in construction and cumbersome to use; therefore, only limited benefits are offered to those who could best utilize them.

DESCRIPTION OF THE RELATED ART

With respect to ease of use, some of the better prior art golf training aids are T-shaped devices placeable upon the ground at the feet of a player. The typical device has a lateral member which may be oriented in the direction of the golf shot and against which the player's feet may be positioned as well as an elongated leg which establishes the proper distance that the lateral member should be placed from the ball. Indicia provided upon the lateral member indicate to the player where his feet should be placed upon the ground. Unfortunately, each of these prior art devices has its drawbacks, drawbacks which will be overcome by the instant invention.

U.S. Pat. No. 1,922,130 issued Aug. 15, 1933 to Haserodt discloses a golfer's stance appliance constructed of lightweight materials suitable for folding into a billfold sized package and, undoubtedly, being difficult to use on breezy days. Additionally, the device has a sequential series of numbers running the length of each of its primary components requiring a player to memorize or record a vast quantity of numerical relationships simply to use the appliance.

U.S. Pat. No. 2,886,326 issued May 12, 1959 to Olds shows a golfer's stance gauge having a telescoping lateral member and a telescoping elongated leg. Disassembly is required for compact storage of the device while not in use.

U.S. Pat. No. 3,459,429 issued Aug. 5, 1969 to Green discloses a golf stance guiding device having a body with three chambers in each of which a separate roll-up tape is housed. Two opposing tapes form the lateral member found in other devices, and indicia placed thereon guide a player's feet to the correct stance. These indicia would be provided by a manufacturer for "average" male and female players and would not be variable to suit an individual whose dimensions deviated from the norm.

U.S. Pat. No. 3,658,344 issued Apr. 25, 1972 to Kimble provides a golfer's stance gauge having slidable foot pads and an elongated leg of bent wire joined to a lateral member by wing nuts. Adjustment of each wing nut is required before a shot may be attempted.

U.S. Pat. No. 4,544,161 issued Oct. 1, 1985 to Guendling, Jr. shows a training aid for hitting golf balls having a one piece T-shaped body. The device will not correct a player's stance since the lateral member is employed as a guide for placement of a golf tee rather than guiding placement of the feet.

None of the above inventions and patents, taken either singly or in combination, is seen to describe the instant golf stance device as claimed.

SUMMARY OF THE INVENTION

The present invention solves many of the problems which the prior art devices of this kind fail to address. The present invention provides a golf stance device having a single housed roll-up tape slidably joined to a lateral member. Indicia marked upon the lateral member by an individual golfer assist in establishing both the proper stance width and position of the golf ball between the feet of said golfer. The instant device may be used in any type of weather and is easily transported and used.

Accordingly, it is a principal object of the invention to provide a suitable structure which may be easily set up and which, when placed on the ground, provides references or indicia which a golfer may utilize in establishing the position of his feet in preparation for striking a golf ball.

It is another object of the invention to provide a golf stance device whereupon the foot placement indicia may be customized to accommodate the dimensions of an individual golfer.

It is a further object of the invention to provide a golf stance device which may be easily transported upon the side of a golf bag well known in the art.

Still another object of the invention is to provide a device which is convenient to use and will increase the rate at which a novice golfer can learn as weil as play the game.

It is an object of the invention to provide improved elements and arrangements thereof in a golf stance device for the purposes described herein which is inexpensive to manufacture, dependable in operation, and fully effective in accomplishing its intended purposes.

These and other objects of the present inventive golf stance device will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figures 1, 2, 2A:
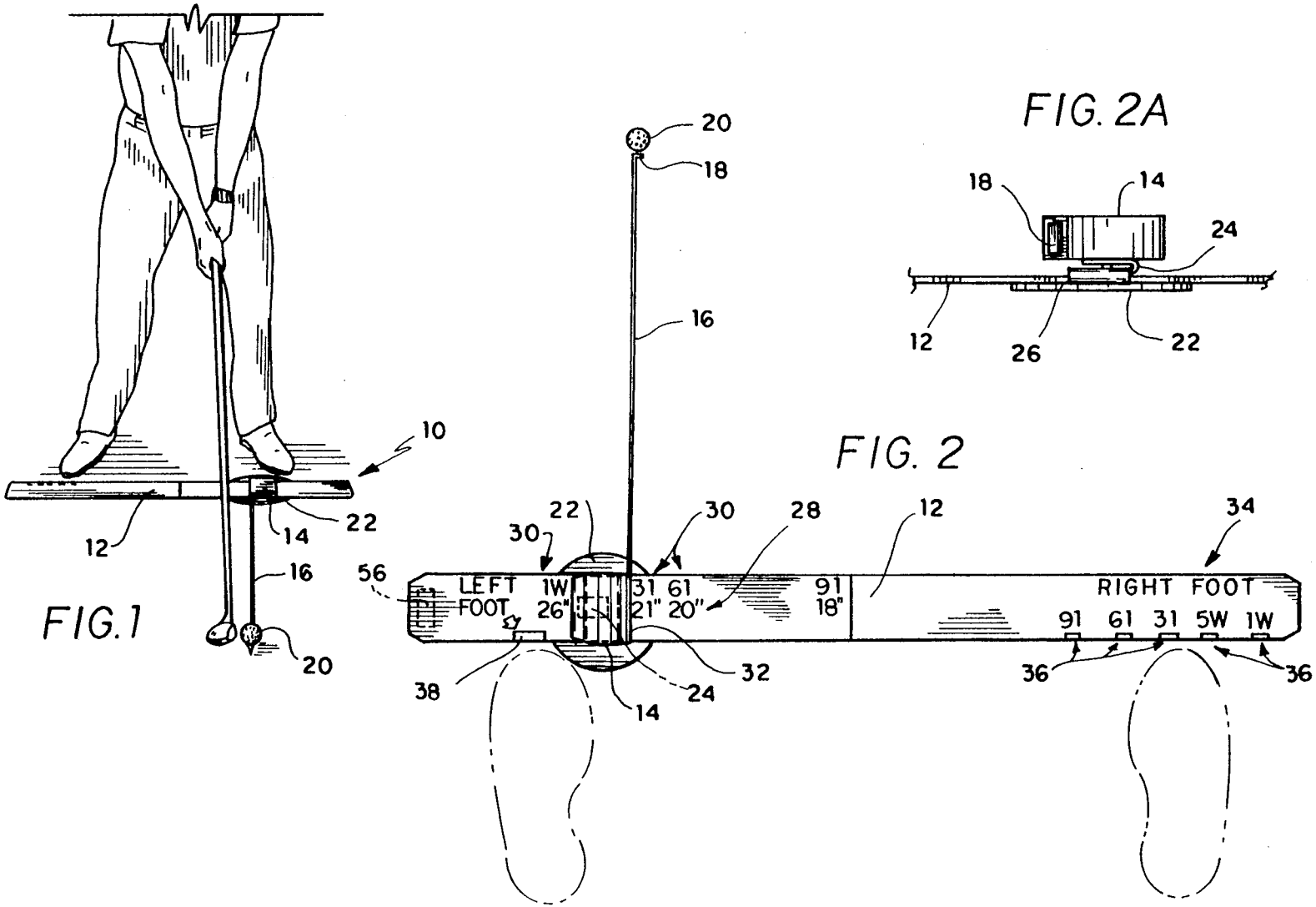
FIG. 1 is a perspective view of a golf stance device in accordance with this invention showing a golfer, upper body cut away, addressing a golf ball.
FIG. 2 is a plan view of a golf stance device in accordance with this invention showing the foot position of the golfer referred to in FIG. 1 in preparation to hit a 3 iron shot.
FIG. 2A is a side view of a golf stance device showing a housing and a linear member joined to a slotted flexible disk.

With reference first to FIGS. 1 and 2, a preferred embodiment of the golf stance device 10 is shown and comprises an elongated and generally flat linear member 12 and a housing 14 slidably engaged therewith. Within housing 14 is a rolled-up extensible tape 16 with an end 18 for guiding alignment with golf ball 20. The construction of tape 16 is immaterial except that such may be drawn in a direction outward from housing 14 and substantially normal to linear member 12. Tape 16 may be self-latching when drawn out, so that same will remain extended as desired, and will roll up or retract within housing 14 under suitable spring bias when released. The end 18 forms a stop to limit the retraction of tape 16 and a handle with which tape 16 may be grasped. Upon tape 16 are markings, not shown, which assist a player in determining the proper distance to draw tape 16 from housing 14. Housing 14 is joined to a flexible disk 22 by clip 24 integral with housing 14 as shown in FIGS. 2 and 2A. The disk 22 has slots 26, seen in FIG. 4A, through which linear member 12 may be inserted. Once inserted, disk 22 and joined housing 14 are free to move axially along the length of linear member 12.

The device 10 may be readily utilized upon the golf course. Linear member 12 has indicia thereon for determining the position of a golfer's feet and housing 14 with respect thereto. Such indicia include a ball positioning scale 28 seen in FIG. 2 on the left side of member 12. Scale 28 has a plurality of spaced markings 30 each of which is labeled with two numerals and a letter. The letters are either "I" for iron or "W" for wood referring to golf club type. The numerals adjacent to, and immediately following, the letters indicate club head pitch, while those immediately below the aforesaid markings refer to the distance to which tape 16 must be drawn from housing 14 for a given shot. Measurements upon scale 28 are read from the right edge 32 of housing 14 and determine the location of the golf ball 20 with relation to the stance. At 34 a "RIGHT FOOT" scale is indicated and has similar indicia 36 and is utilized in positioning the right foot upon the ground.

In establishing a stance, a golfer must first determine the club with which he will execute a given shot. Housing 14 is axially moved into position such that its right edge 32 is in alignment with indicia on scale 28 corresponding with the appropriate numerical and letter indicators for the club. The tape 16 will be withdrawn from housing 14 to a distance indicated on scale 28 and the device 10 will be appropriately placed upon the ground relative to ball 20. The golfer will next align the toe of his right foot with the indicia appropriate for the desired club on "RIGHT FOOT" scale 34. Regardless of the club to be utilized, a golfer's left toe will always be positioned against the toe marker 38 found adjacent to scale 28.

Linear member 12 may be delivered to a golfer without indicia so that he may provide such in accordance with principles well known in the art and tailored to individual specifications. A marking pen 40 shown in FIG. 4F is provided with the device and may be utilized to accomplish this end.

Figure 3:
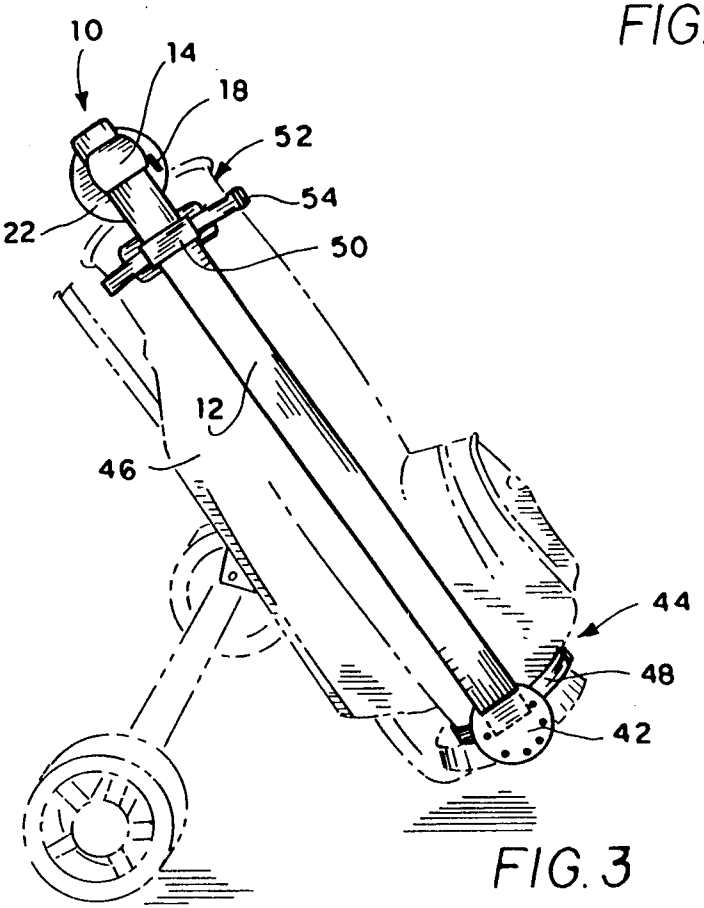
FIG. 3 is a perspective view of a golf stance device and mounting apparatus in accordance with this invention upon a golf bag.

The device 10 may be conveniently transported about the golf course within a golf bag or may be carried upon the exterior of such as shown in FIG. 3. A holster 42 secured to the lower end 44 of golf bag 46 by fabric strap 48 forms a pocket into which one end of linear member 12 may be inserted. A retaining loop 50 secured to the upper end 52 of golf bag 46 by fabric strap 54 forms a ring through which the linear member may be inserted.

Figure 4B:
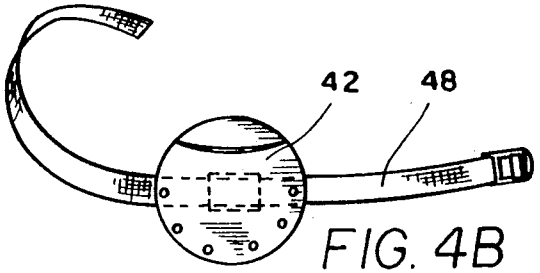
FIG. 4B is a side view of a holster and fabric strap for joining the inventive device to a golf bag.
Figure 4A:
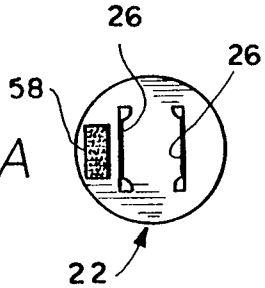
FIG. 4A is a plan view of a slotted flexible disk for joining the housing to the linear member.
Figure 4C:
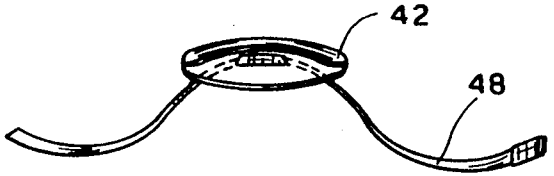
FIG. 4C is a top view of the holster and strap shown in FIG. 4B.
Figure 4D:
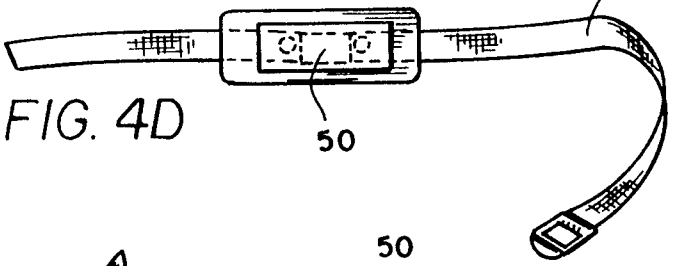
FIG. 4D is a side view of a retaining loop and fabric strap for joining the inventive device to a golf bag.
Figure 4E:
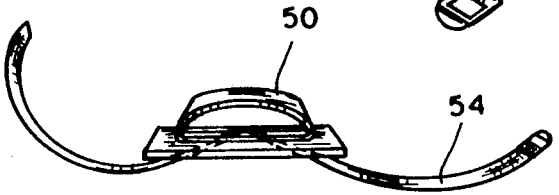
FIG. 4E is a top view of the retaining loop and strap shown in FIG. 4D.
Figure 4F:
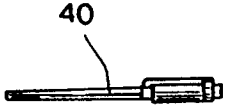
FIG. 4F is a side elevational view of a marking pen for providing indicia upon the linear member of the inventive device.

In order to prevent the housing 14 from unintentionally disengaging from linear member 12, opposing hook and loop fabric swatches 56 and 58 are provided to linear member 12 and flexible disk 22 as seen in FIGS. 2 and 4A. Additionally, swatches 56 and 58 retain housing 14 in a convenient position for transport on golf bag 46.

It is to be understood that the present inventive golf stance device is not limited to the sole embodiment described above, but encompasses any and all embodiments within the scope of the following claims.

I claim:

1. A golf stance device for properly locating the feet of a golfer on the ground with respect to a golf ball comprising:

a linear member adapted to rest upon the ground, and adapted to receive indicia to guide the location of the golfer's feet;

a housing; means for slidably connecting said housing to said linear member; and, a rolled-up extensible tape in said housing, said tape adapted to be drawn in a direction outward from said housing and substantially normal to said linear member, said tape having markings thereon for determining the extent to which said tape may be drawn from said housing; and a flexible disk joined to said housing, said flexible disk having a plurality of slots therein for slidably engaging said housing with said linear member so that slidable engagement is accomplished by inserting said linear member through said slots.

2. The golf stance device according to claim 1 further comprising:

retaining means for preventing said housing from unintentionally disengaging from said linear member.

3. The golf stance device according to claim 2 wherein said retaining means includes:

hook and loop fabric means.

4. The golf stance device according to claim 3 further comprising:

a marking tool for providing indicia upon said linear member;

means for mounting said device upon the side of a golf bag including:

a holster adapted to be secured to the lower end of a golf bag, said holster forming a pocket into which one end of said linear member may be inserted;

a retaining loop adapted to be secured to the upper end of a golf bag, said retaining loop forming a ring through which said linear member may be inserted; and a plurality of fabric straps for securing said holster and said retaining loop to a golf bag.

5. The golf stance device according to claim 1 further comprising:

a marking tool for providing indicia upon said linear member.

6. The golf stance device according to claim 5 wherein said marking tool includes:

a marking pen.

7. The golf stance device according to claim 1 further comprising:

means for mounting said device upon the side of a golf bag.

8. The golf stance device according to claim 7 wherein said mounting means includes:

a holster adapted to be secured to the lower end of a golf bag, said holster forming a pocket into which one end of said linear member may be inserted;

a retaining loop adapted to be secured to the upper end of a golf bag, said retaining loop forming a ring through which said linear member may be inserted; and, attachment means for securing said holster and retaining loop to a golf bag.

9. The golf stance device according to claim 8 wherein said attachment means includes:

a plurality of fabric straps.

10. The golf stance device according to claim 9 in combination with a golf bag.

11. A golf stance device for properly locating the feet of a golfer on the ground with respect to a golf ball comprising:

a linear member adapted to rest upon the ground, and adapted to receive indicia to guide the location of the golfer's feet;

a housing slidably engaged with said linear member;

a rolled-up extensible tape in said housing, said tape adapted to be drawn in a direction outward from said housing and substantially normal to said linear member;

a flexible disk joined to said housing, said flexable disk having a plurality of slots therein for slidably engaging said housing with said linear member, whereby slidable engagement is accomplished by inserting said linear member through said slots;

hook and loop fabric means for preventing said housing from unintentionally disengaging from said linear member;

a marking tool for providing indicia upon said linear member;

means for mounting said device upon the side of a golf bag including:

a holster adapted to be secured to the lower end of a golf bag, said holster forming a pocket into which one end of said linear member may be inserted;

a retaining loop adapted to be secured to the upper end of a golf bag, said retaining loop forming a ring through which said linear member may be inserted; and a plurality of fabric straps for securing said holster and said retaining loop to a golf bag.

* * * * *